United States Patent [19]

Collins et al.

[11] Patent Number: 4,824,272

[45] Date of Patent: Apr. 25, 1989

[54] PAINT VALVE

[75] Inventors: Scott J. Collins; Timothy B. Strandell, both of Milwaukee, Wis.

[73] Assignee: Brenner Associates, Ltd., Englewood, N.J.

[21] Appl. No.: 121,451

[22] Filed: Nov. 16, 1987

[51] Int. Cl.[4] ..... B05C 17/02; B05C 1/10

[52] U.S. Cl. ..... 401/197; 401/144; 401/203; 141/350

[58] Field of Search ..... 401/197, 203, 204, 144; 141/382, 383, 386, 346–348, 350

[56] References Cited

U.S. PATENT DOCUMENTS

| | | | |
|---|---|---|---|
| 2,964,769 | 12/1960 | Mercereau | 401/197 X |
| 3,337,899 | 8/1967 | Rentfrow | 401/144 X |
| 3,554,659 | 1/1971 | Stokes | 401/197 |
| 3,765,462 | 10/1973 | Hocq | 141/348 X |
| 3,871,422 | 3/1975 | Elson et al. | 141/348 X |
| 4,583,876 | 4/1986 | Karliner et al. | 401/197 |
| 4,695,176 | 9/1987 | Simonette et al. | 401/144 |
| 4,732,503 | 3/1988 | Bader et al. | 401/197 |

*Primary Examiner*—Richard J. Apley
*Assistant Examiner*—Franklin L. Gubernick
*Attorney, Agent, or Firm*—Richard A. Joel

[57] ABSTRACT

A paint valve for use with an automatic roller apparatus comprises a valve body connected at one end to the roller to provide paint thereto and at the other end to a paint reservoir in the handle. A valve stem is mounted within a cavity in a portion projecting outwardly at an angle from the body. The valve stem is designed to engage a fill tube mounted on a paint can. Pushing down on the fill tube forces the stem upwardly opening the valve cavity and paint reservoir tube and closing the cavity to the roller head. A pump shaft creates a suction drawing paint through the fill tube, valve stem and out two holes in the stem into a paint reservoir. When the valve body is removed from the end of the fill tube, the valve closes off the intake and opens the cavity leading to the roller head.

4 Claims, 2 Drawing Sheets

PAINT VALVE

BACKGROUND OF THE INVENTION

One of the recent innovations in painting has been the development of various roller apparatus which contain their own paint supply. The roller apparatus are filled directly from a can which has a specially designed cap positioned thereover with a filler tube protruding upwardly therefrom. This eliminates the need for messy roller trays and speeds up the painting process.

In one current device, a rubber sleeve is placed in contact with the input tube. The sleeve has a slit in one end which allows the sleeve to remain in a normally closed position. The tube is pushed through the slit opening a passage to a paint reservoir in the handle which is coupled to the roller. Another device includes a spring-activated plunger type valve stem which is activated by a push-button on the valve body. The paint filler tube is inserted into a hole in the valve body and the button is then pushed.

U.S. Pat. Nos. 3,231,151 to Clark et al and 4,140,410 to Garcia are of interest in this area but are not extremely relevant.

The present invention is an improvement over the present commercial devices and the existing prior art as will be described in detail hereinafter.

SUMMARY OF THE INVENTION

The present invention comprises a paint valve for use with automatic roller apparatus which contain their own reservoir. The valve is mounted to a roller at one end and supplies paint thereto from a reservoir in an elongated hollow handle which is mounted to the other end of the valve. A valve stem is mounted within a cavity in a portion of the valve body which extends outwardly at an angle to the body. The spring-backed valve is designed to engage a filler tube on a paint can which forces the valve upwardly within the cavity.

In operation, valve stem is forced against the filler tube and moves upwardly within the cavity opening the paint reservoir and closing the opening to the roller head. A pump shaft on the roller handle creates a vacuum drawing paint through the fill tube, valve stem and out a pair of apertures into a paint reservoir. When the reservoir is filled, the valve body is removed from the end of the fill tube. The valve closes off the intake and opens the cavity leading from the reservoir to the roller head. In painting, the pump shaft is slowly pushed back into the reservoir tube forcing the paint through the valve capacity and into the roller head where it is forced out through a plurality of holes.

Accordingly, an object of this invention is to provide a new and improved valve for use with automatic roller apparatus.

A further object of this invention is to provide a new and improved paint valve which is more efficient and reliable than the prior art.

A more specific object of this invention is to provide a new and improved paint valve for roller apparatus which provides a mechanical loading action and can be easily dismounted in the field for servicing.

BRIEF DESCRIPTION OF THE DRAWINGS

The above and other objects and advantages of the present invention may be more. Clearly seen when viewed in conjunction with the accompanying drawings wherein.

DETAILED DESCRIPTION OF THE INVENTION

Figure 1:
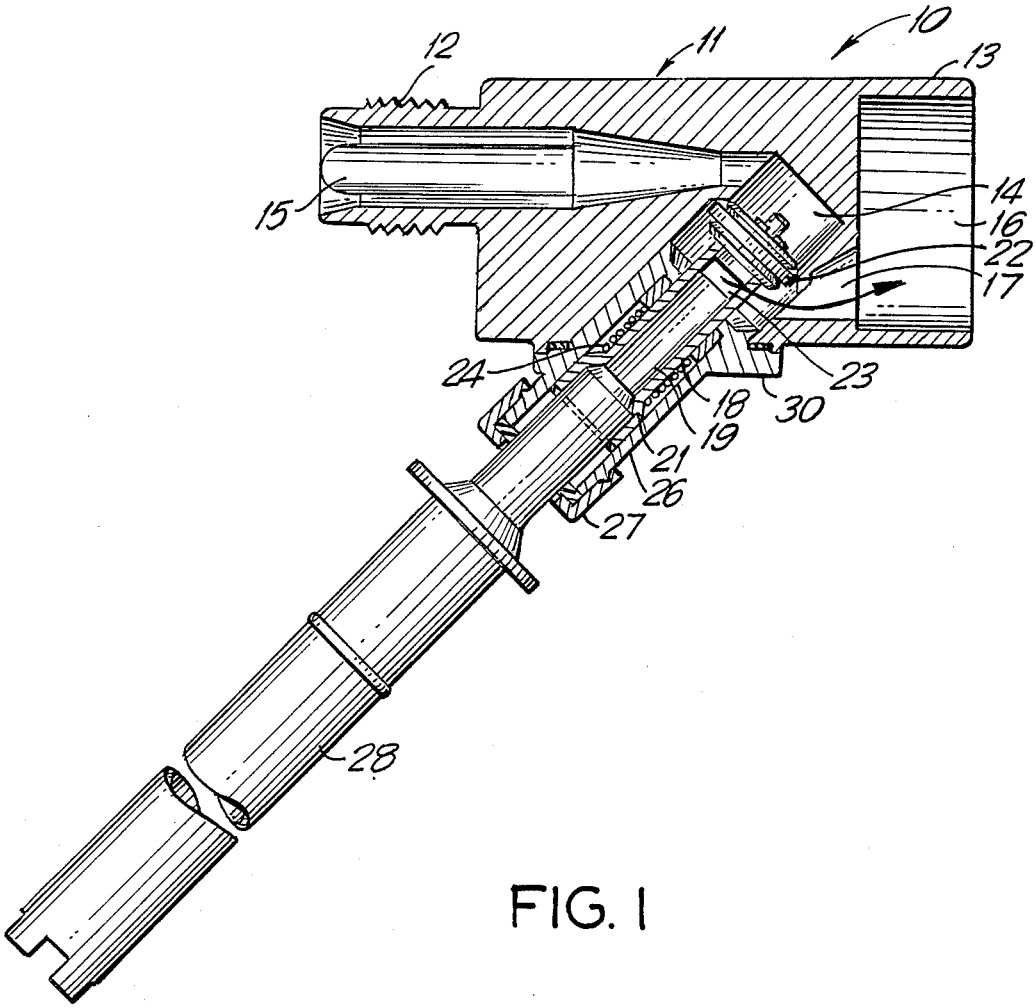
FIG. 1 is a side view of the invention with the valve in a loading position; parts of said valve being shown in cross section.

Referring to FIG. 1 of the drawings, the valve 10 comprises a valve body 11 having a threaded portion 12 at one end for coupling to a roller (not shown) and an enlarged portion 13 at the other end for coupling to the paint reservoir end of a paint handle (not shown). The valve body 11 includes an aperture 15 leading from the valve stem cavity 14 to the roller. The valve stem cavity 14 is also connected to the reservoir 16 via passage 17.

The valve stem 18 includes a hollow main body portion 19 having an enlarged lower portion or seat 21 which can engage a filler tube and an enlarged upper portion having a washer 22 mounted thereon. A pair of flow ports 23 are positioned in the upper portion of the stem walls. The body portion 19 is surrounded by a spring 24 which urges the stem 18 into a closed position as shown in FIG. 2.

The valve stem is mounted within the angularly projecting portion 26 which includes a protective cap 27 positioned over the exposed end. FIG. 1 depicts the valve stem 18 being pushed backwardly by a filler tube 28 against which the valve is being pushed. A suction created by the pump shaft (not shown) being drawn out of the reservoir 16 draws the paint through the tube, (which is mounted on a paint can) the valve stem 18 and outwardly from the parts 23 through passage 17 into the reservoir 16 in the direction of the arrows. When the reservoir 16 is filled, the valve body 11 is removed from the fill tube 28 closing off the intake and opening the cavity leading to the roller head.

Figure 2:
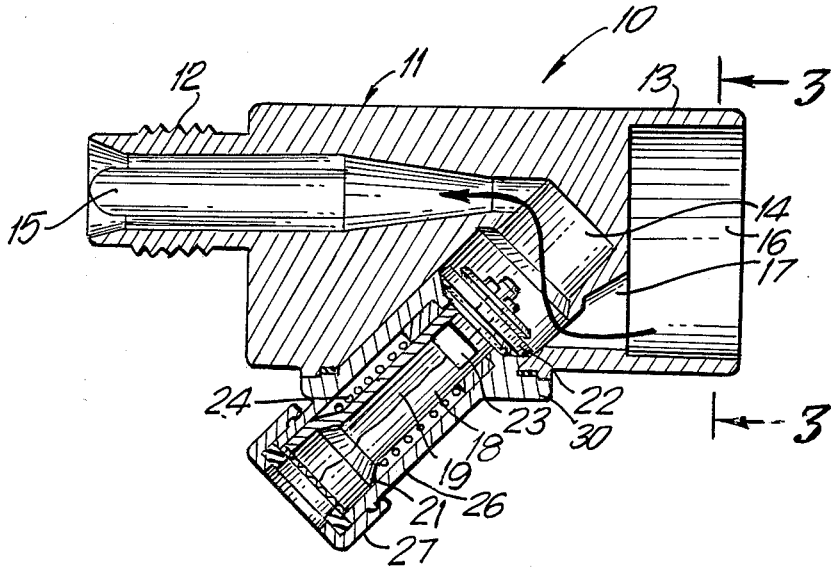
FIG. 2 is a side view of the valve comprising the invention in an operative condition during painting.

FIG. 2 depicts the valve 10 in a painting position wherein paint flows in the direction of the arrow from the reservoir 17 through the valve cavities 17 and 13 to the roller head. The pump shaft is slowly pushed into the reservoir tube during painting until depleted. The paint flows from the cavity 13 into the roller head and is forced out through a number of holes.

Figure 3:
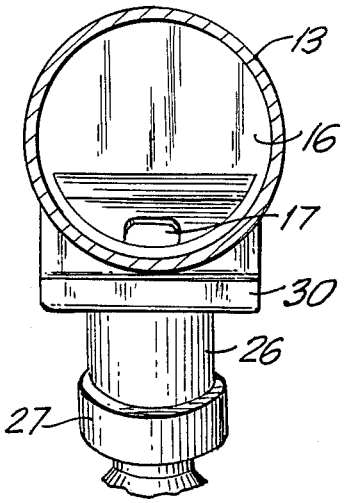
FIG. 3 is a view of the invention taken along the line 3—3 of FIG. 2.

FIG. 3 depicts a view from the reservoir 16 into the passage 17 which supplies paint to the reservoir 16.

Figure 4:
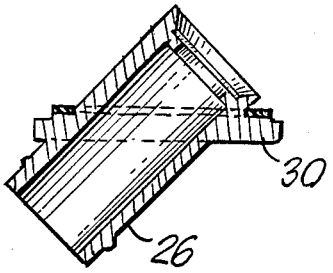
FIG. 4 is a cross sectional view of the valve stem cavity.
Figure 5:
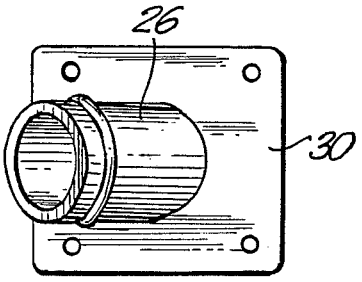
FIG. 5 is a perspective view of the housing for the valve stem.

FIGS. 4 and 5 depict the sleeve cap 30 in greater detail. As a separate part having one valve stem 18 mounted therein the cap 30 may be readily removed and the valve unit serviced.

It is understood that the above-described arrangements are merely illustrating examples of the invention. Numerous other arrangements may be readily devised by those skilled in the art which well embody the principles of the invention and fall within the spirit and scope thereof.

What is claimed is:

1. A paint valve for loading a roller apparatus from a paint supply means which includes a filler tube, said valve having a roller channel and a paint supply channel coupled to the valve at one end and a handle having a paint reservoir mounted therein coupled to the other end of the valve comprising:

a valve body having a main portion and a secondary portion of smaller diameter than said main portion projecting outwardly at one end, said secondary portion having a bore extending inwardly to provide a paint path to a roller and a threaded outer wall for mounting to a roller, said main portion including a bore extending inwardly at an angle and connected to said reduced portion bore and an outlet bore joined to the paint reservoir in the handle, and a valve mounted within said valve body having a valve stem, said valve stem having a filler tube engaging portion mounted at an outer end, a cavity extending axially therealong, and at least one port in the stem wall at the inner end thereof connecting to said cavity, a removable sleeve mounted about the outer end of the valve stem, said sleeve being mounted to the valve body and engageable with the paint supply means to load the reservoir.

2. A paint valve in accordance with claim 1 wherein:

the valve includes resilient means maintaining the valve stem in a normally open position wherein paint flows from the reservoir through the valve to the roller channel.

3. A paint valve in accordance with claim 2 wherein:

the filler tube engaging portion of said valve stem includes an enlarged outer end portion to be engaged by the paint supply means moving said valve stem inwardly to block the paint path to the roller for and opening a path through the stem to the reservoir.

4. A paint valve in accordance with claim 1 further including:

means connected to the reservoir to provide a suction drawing paint through the valve stem to the reservoir.

* * * * *